US006433686B1

(12) United States Patent
Feibelman

(10) Patent No.: US 6,433,686 B1
(45) Date of Patent: Aug. 13, 2002

(54) SECURITY TAG

(75) Inventor: Jeffrey A. Feibelman, Providence, RI (US)

(73) Assignee: Display Technologies, Inc., Johnston, RI (US)

( * ) Notice: Subject to any disclaimer, the term of this patent is extended or adjusted under 35 U.S.C. 154(b) by 0 days.

(21) Appl. No.: 09/755,223

(22) Filed: Jan. 5, 2001

(51) Int. Cl.[7] ..... G08B 13/14

(52) U.S. Cl. ..... 340/572.8; 340/572.1; 340/572.7; 340/572.9; 340/568.1

(58) Field of Search ..... 340/572.8, 572.9, 340/568.1, 572.1, 571, 572.7

(56) References Cited

U.S. PATENT DOCUMENTS

| | | | | | |
|---|---|---|---|---|---|
| 5,100,006 | A | * | 3/1992 | Forrester | 248/902 |
| 5,437,172 | A | | 8/1995 | Lamy et al. | |
| 5,593,025 | A | | 1/1997 | Feibelman | |
| 5,867,102 | A | * | 2/1999 | Souder et al. | 340/572.8 |
| 5,945,909 | A | | 8/1999 | Kolton | |
| 5,982,282 | A | | 11/1999 | Ryan, Jr. | |
| 5,982,284 | A | * | 11/1999 | Baldwin et al. | 340/572 |
| 5,986,562 | A | | 11/1999 | Nikolich | |
| 5,988,462 | A | | 11/1999 | Kolton | |
| 6,023,871 | A | | 2/2000 | Horowitz | |
| 6,067,016 | A | * | 5/2000 | Deschenes et al. | 340/572.8 |
| 6,135,407 | A | * | 10/2000 | Havis et al. | 248/309.1 |
| 6,157,302 | A | * | 12/2000 | Kolton et al. | 340/572.7 |
| 6,199,309 | B1 | | 12/2000 | Markarian | |
| 6,254,953 | B1 | * | 7/2001 | Elston | 340/572.8 |

* cited by examiner

*Primary Examiner*—Jeffery Hofsass
*Assistant Examiner*—Daniel Previl
(74) *Attorney, Agent, or Firm*—Salter & Michaelson

(57) ABSTRACT

An anti-theft tag including a body portion having at least a first member for supporting an electronic article surveillance marker, and a second member including an opening for receiving at least a portion of the EAS marker there through is provided. The EAS marker is preferably supported on an inner surface of the first member and is sized to fit within the opening in the assembled position. The body portion is preferably folded such that the second member at least partially overlays the first member and the EAS marker is received within the opening in the assembled position. A pre-formed fold line may be disposed between the first and second member in order to facilitate folding of the body portion. In one embodiment, a third member is provided, which may be positioned over the second member such that the EAS marker is sandwiched between the first and the third members.

24 Claims, 11 Drawing Sheets

210
216
227
229b
222
221

216
220
222
229
229a
214
221
223
228
224
218
226

SECURITY TAG

DESCRIPTION

1. Technical Field

The invention relates generally to a security tag and, more specifically to an improved anti-theft tag for supporting an electronic article surveillance marker.

2. Background of Related Art

Various devices have been utilized by retailers in order to prevent theft of their goods. A widespread practice in the industry of article security is the use of anti-theft tags which incorporate electronic article surveillance (EAS) markers. These types of tags are typically secured to an article and are either removed or rendered inactive at checkout. In some cases the markers are visible to consumers, and in other cases the markers are hidden from view in order to is prevent unauthorized removal. In either case, if the markers are not rendered inactive or removed, they will be sensed by the EAS system causing an alarm to signal, for example when exiting the store. It is desirable that anti-theft tags be easy to manufacture and apply to the article while being difficult to detect and/or to remove by consumers.

One common form of EAS markers is a flat, thin, flexible rectangular member which is applied adhesively to a flat or curved exterior surface of the article. One shortcoming of such exterior surface application by adhesive is that the marker may be easily seen and removed by a consumer. Attempts have been made to manufacture thin, flat EAS markers which are laminated between sheets of a tag or label so as to not be noticeably visible to the consumer. For example, U.S. Pat. No. 5,982,284 to Baldwin et al. describes an anti-theft tag or label that has a thin, flat, flexible device laminated within the tag or label in such a manner that the edges of the device are masked so as not to give away the presence of the device. While these attempts have had some success, they can present manufacturing difficulties. In addition, some articles (for example glasses and jewelry) are inherently difficult to apply EAS markers to without detecting the marker. Such articles are generally small in size and do not have many areas to attach such a marker.

Accordingly, there is continued development in the art of anti-theft tags which are easy to manufacture and which can be applied to even small articles without being readily discovered and/or removed by consumers.

SUMMARY

An object of the present invention is to provide an anti-theft tag which is easy to manufacture and assemble and which can be utilized with a variety of products.

In accordance with one aspect, there is provided an anti-theft tag including a body portion having at least a first member for supporting an electronic article surveillance marker, and a second member including an opening for receiving at least a portion of the EAS marker there through. The EAS marker is preferably supported between an inner surface of the first member and the second member, is sized to at least partially fit within the opening in the assembled position. The body portion is preferably folded such that the second member at least partially overlays the first member. In a preferred embodiment, a pre-formed fold line is disposed between the first and second member in order to facilitate folding of the body portion. In one embodiment, a third member is provided, which may be positioned over either the first or second member. If positioned over the second member, the EAS marker is sandwiched between the first member and the third member. When assembled, the thickness of the EAS marker and second member may be such that the EAS marker is substantially equal in height, or level with the rear surface of the second member when received through the opening. In this manner, a label may be placed over the opening and EAS marker and appear substantially flat, without a noticeable bulge indicating the presence of an EAS marker. Alternatively, the assembled thickness of the EAS marker may be greater than the second member, such that the EAS marker extends from the opening, for example if the EAS marker is sandwiched between the first member and the third member. An engagement member may also be provided for securing the anti-theft tag to an article. The body portion may also include indicia, such as price, manufacturer, or other information for display to the consumer.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENTS

Figure 1:
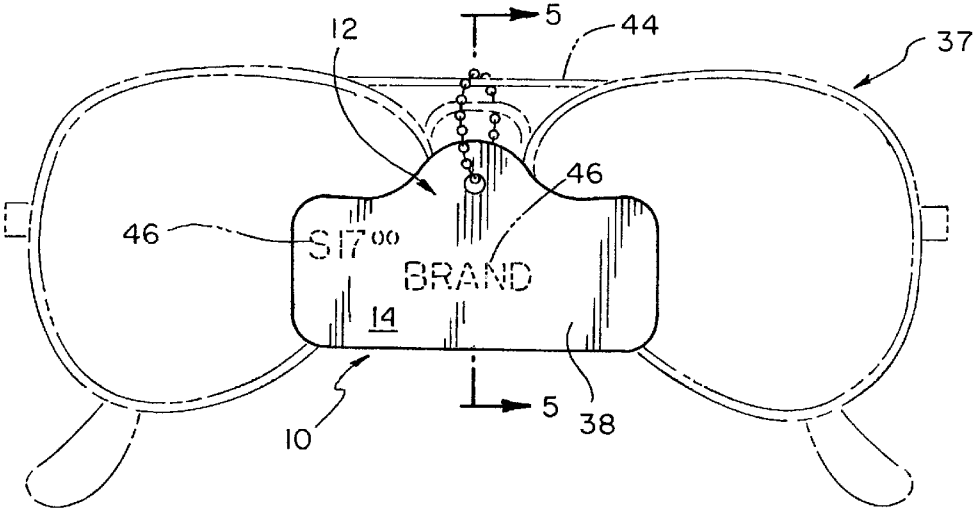
FIG. 1 is a front view of a first embodiment of an anti-theft tag according to the present invention attached to an article.

An anti-theft tag 10 for preventing theft of an article is illustrated in FIGS. 1–10. As used herein, the term "article" refers to any item or product sold to a consumer. Also as used herein, the term "EAS marker" is used in the conventional sense to mean any of a number of electronic article surveillance markers, as would be known to those of skill in the art. For example, the EAS marker may comprise a ferro magnetic member. EAS markers are widely available and may be purchased from such companies as Sensormatic Electronics Corporation of Boca Raton, Fla.

Referring initially to the FIGS. 1–5, a first embodiment of the anti-theft tag 10 includes an engagement member 12 for securing the anti-theft tag to an article, and a body portion 14 having at least a first member 16 and a second member 18. In the present embodiment, the engagement member is an opening or aperture 19 formed in the body portion at one end thereof. The first member 16 includes a rear or an inner surface 20 and a front or outer surface 22, both of which are preferably substantially planar. The second member 18 also preferably includes an inner surface 24, an outer surface 26, both of which are also preferably substantially planar and an opening 28 disposed through the second member 18 and extending between the inner and outer planar surfaces. The first and second members may preferably be formed as a unitary member, such that the body portion is folded when assembled and the second member at least partially, and preferably substantially, overlays the first member.

Figure 5:
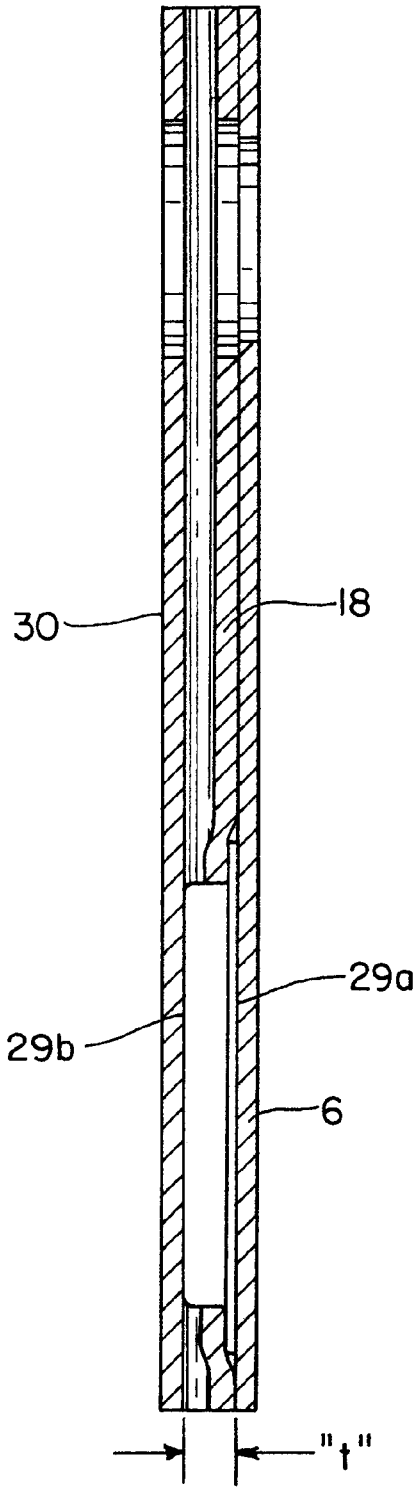
FIG. 5 is a side, cross-sectional view of the anti-theft tag taken along lines 5—5 of FIG. 1.
Figure 7:
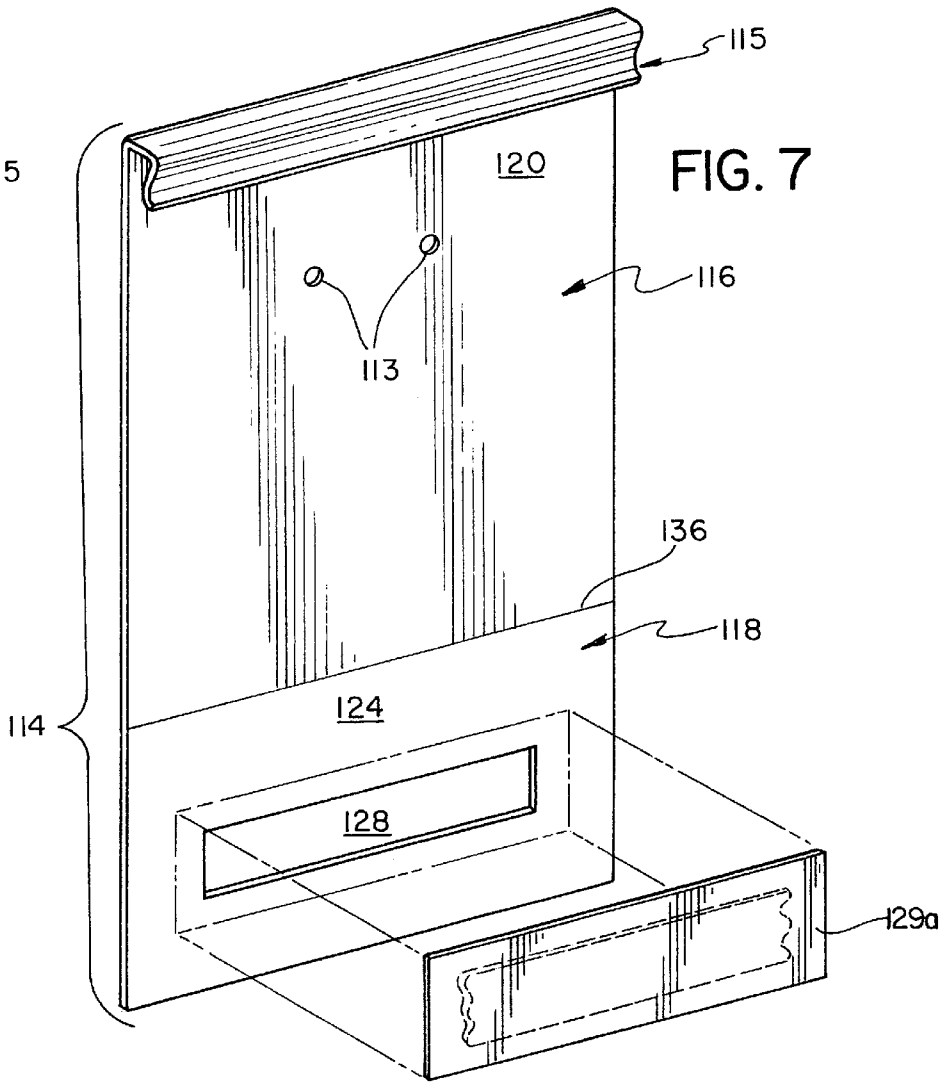
FIG. 7 is a rear, perspective view of the anti-theft tag of FIG. 6 in an open or unassembled position.
Figure 6:
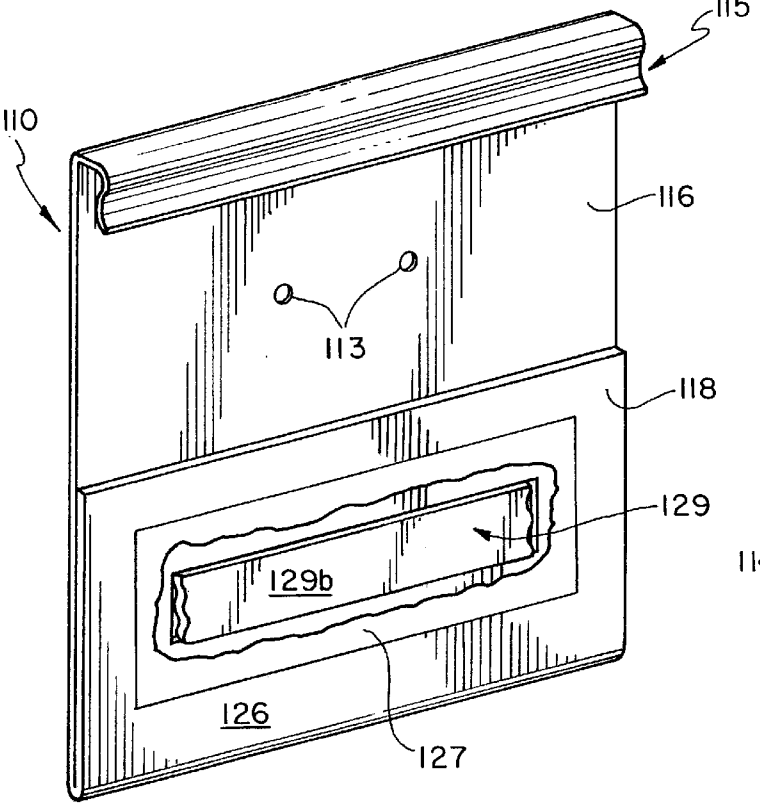
FIG. 6 is a rear, perspective view of a second embodiment of an anti-theft tag according to the present invention.

An electronic article surveillance (EAS) marker 29, may be supported on the inner surface 20 of the first member and is preferably sized such that at least a portion of the marker fits within the opening 28 in an assembled position (FIG. 5). A rear, substantially planar base 29*a* of the EAS marker may be provided with a suitable adhesive so as to secure the EAS marker to the inner planar surface of the first member. Alternatively, an adhesive may be applied to a front surface 29*b* of the marker, around a perimeter thereof, and secured to the inner surface 24 of the second member. In either case, the thickness, "t", of the EAS marker when assembled may be such that the EAS marker extends through the opening 28, and is higher than the outer surface 26 of the second member as shown in FIG. 5. For example, if the EAS marker is sandwiched between the first member and a third member 30, the EAS marker may extend through the opening and the EAS marker would nevertheless be concealed by the third member. Alternatively, the assembled thickness of the EAS marker and second member may be such that the EAS marker is substantially equal in height, or level with the rear surface of the second member when received through the opening, as described in greater detail below.

Figure 2:
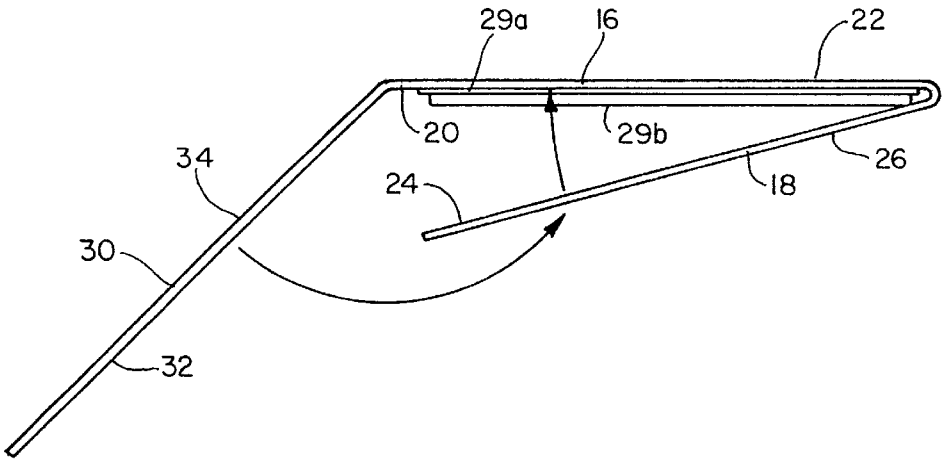
FIG. 2 is a top plan view of the anti-theft tag of FIG. 1.
Figure 3:
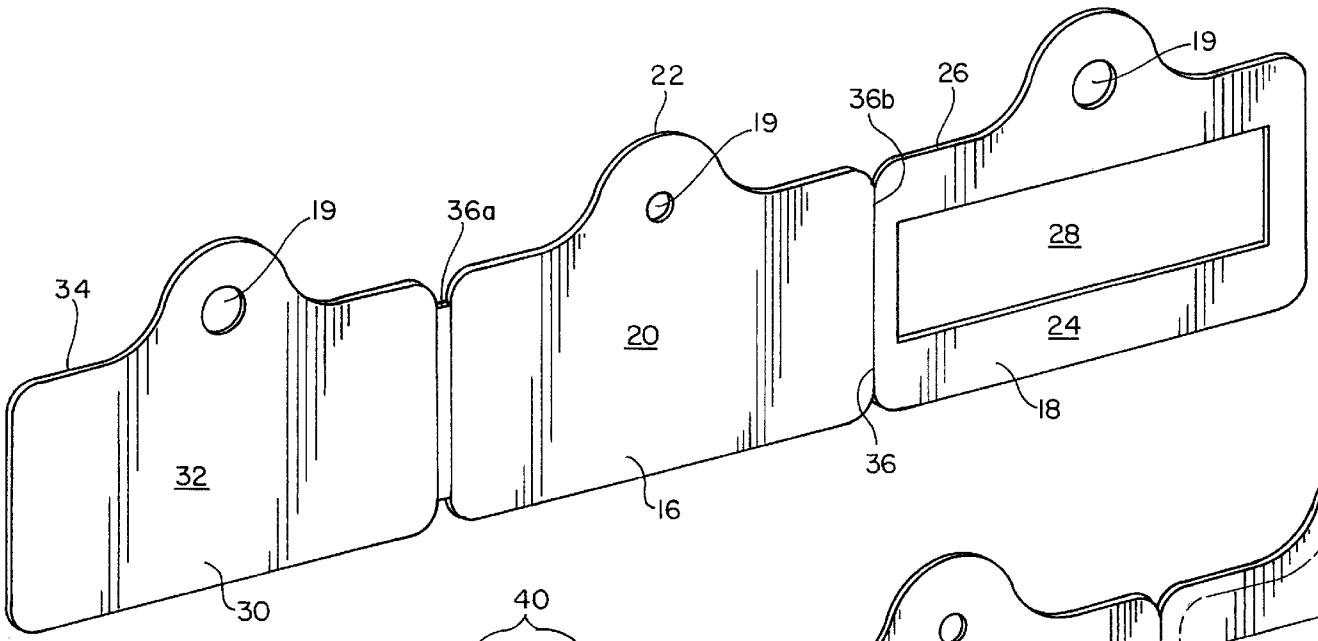
FIG. 3 is a front view of the anti-theft tag of FIG. 1 in an open position without an EAS marker.
Figure 4:
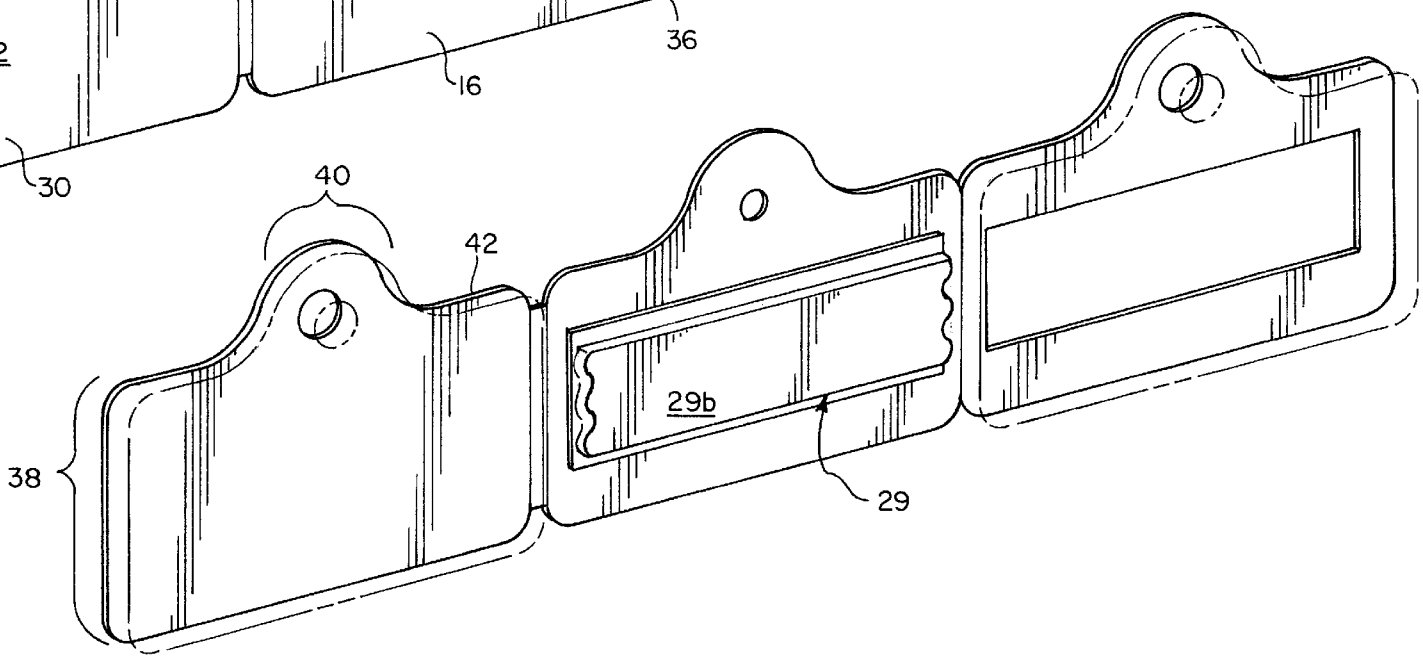
FIG. 4 is a front view of the anti-theft tag of FIG. 1 in an open position with an EAS marker attached.

In the present embodiment, third member 30 may also be provided which preferably includes a substantially planar inner 32 and outer 34 surface. The third member 30 is preferably supported on the first member 16 and at least partially overlays the second member 18 in the assembled position (FIG. 2). In this manner, the EAS marker 29 and second member 18 are both preferably sandwiched between the first member and the third member in order to conceal the EAS marker, as described above. The first, second and third members may be formed as a single, unitary member and may include pre-formed score or fold lines 36*a, b* disposed therebetween in order to assist in the assembly of the tag. In order to facilitate the thickness of the assembled tag, fold line 36*a* may preferably be formed as a connecting tab, such that a piece of additional material is disposed between the first and third members.

The tag 10 may have any of a variety of shapes, depending upon the particular application or upon the preference of the designer. For example, in the embodiment of FIGS. 1–5 the tag is designed for use with eye wear 37. For this particular application the body 14 may have a generally rectangular shape 38, and the portion containing the aperture 19 may have an arcuate shape 40 which extends from an upper edge 42 of the rectangle. This configuration is particularly suitable for use with eye wear since the arcuate portion may be attached to the bridge 44 of the eyewear and hang therefrom as shown in FIG. 1. The body portion may include indicia 46, such as price, manufacturer, or other information, and preferably does not overly obscure the eyes of the wearer. It will be appreciated that this configuration of the body allows a consumer to try on the eye wear prior to purchasing, without the anti-theft tag preventing the consumer from viewing how the eye wear looks on him or her. The tag 10 may likewise be made of any suitable material, for example laminated paper, plastic, cardboard, etc. as would be known to those of skill in the art.

Referring now to FIGS. 6–9, a second embodiment of the anti-theft tag is illustrated. In this embodiment, all parts which are the same, or similar to, corresponding parts of the embodiment 10 of FIGS. 1–5 are noted with the same two last numbers, but preceded by the numeral "1". In the present embodiment, tag 110 is formed into a display card for supporting and displaying an article thereon, for example an article of jewelry. Display card 110 includes a body portion 114 having a support member 113 designed to hold and display an article on an outer surface thereof. The support member may be any of a number of conventional support members known in the art, including but not limited to one or more apertures for receiving earrings, pins, etc., one or more slots (not shown) for receiving a necklace, bracelet or other items, and the like. In the present embodiment, the support member is a pair of apertures formed through a first member 116 of the body portion. The first member 116 includes a rear surface 120 and a front surface 122, both of which are preferably substantially planar. The support member 113 is designed to display an article on the front surface 122 thereof.

Supported on an upper end of the first member 116 is a display member 115 designed to removably engage the card with a display component. The display member 115 may take any of a variety of forms, suitable for engagement with a display component, as would be known to those of skill in the art. For example, in the present embodiment the member 115 is a hook for engaging a display rack, but may also be formed as an aperture for attachment to a display rod, or other member for engagement with a corresponding display component.

A second member 118 is preferably supported on a lower end of the first member and also preferably includes a rear 124 and a front 126 surface, both of which are also preferably substantially planar. Opening 128 is disposed through the second member 118, between the front and rear planar surfaces. An electronic article surveillance (EAS) marker 129, may be supported on the inner surface 120 of the first member and is preferably sized such that at least a portion of the marker fits within the opening 128 in an assembled position (FIG. 5). A rear, substantially planar base 129*a* of the EAS marker may be provided with a suitable adhesive so as to secure the EAS marker to the inner planar surface of the first member. Alternatively, an adhesive may be applied to a front surface 129*b* of the marker, around a perimeter thereof, and secured to the inner surface 124 of the second member.

Figure 9:
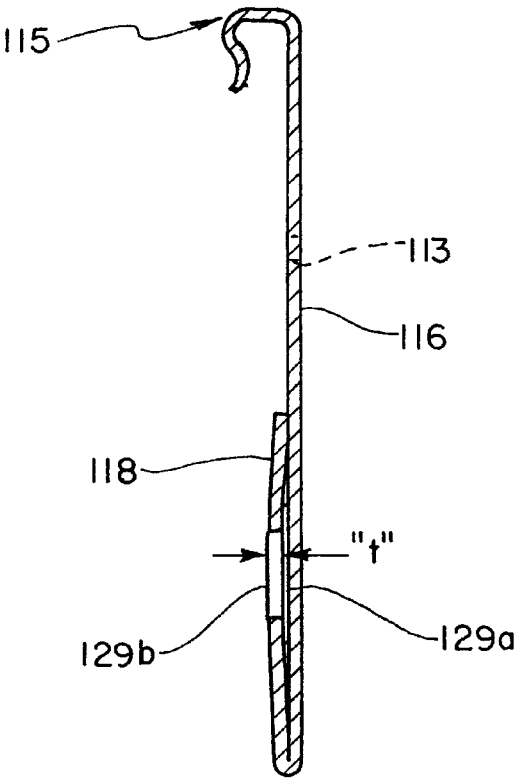
FIG. 9 is a side, cross-sectional view taken along lines 9—9 of FIG. 8.
Figure 8:
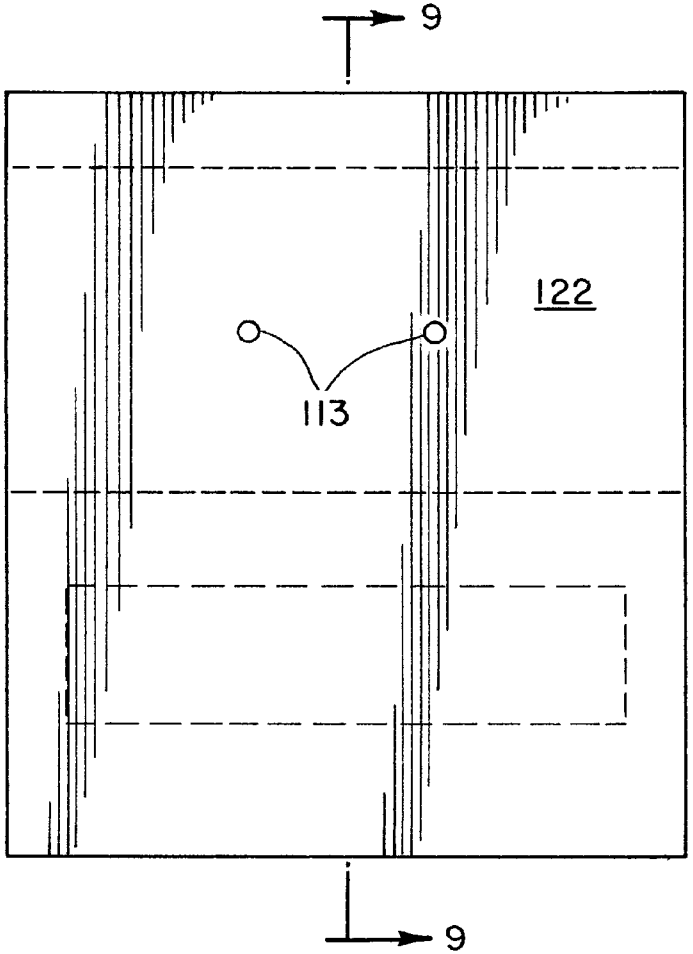
FIG. 8 is a front view of the anti-theft tag of FIG. 6.

The thickness of the EAS marker and second member in the present embodiment may be such that the front surface 129*b* of the EAS marker is substantially equal in height, or level with the rear surface of the second member when received within the opening (FIG. 9). In this manner, a label 127 may be placed over the opening 128 and EAS marker and secured to the rear surface of the second member such that the label appears substantially flat, without a noticeable bulge indicating the presence of an EAS marker. Alternatively, the EAS marker may extend through the opening and not be substantially level with the rear surface of the second member, as described in greater detail above with respect to the embodiment of FIGS. 1–5.

In the present embodiment, the card 110 may preferably be formed as a unitary, molded semi-flexible plastic member which can be folded without breaking. In order to facilitate folding of the body portion, a pre-formed score of fold line 136 may be provided between the first and second members such that the second member at least partially overlays the first member when assembled. The fold line 136 may be formed in any suitable manner, as would be known to those of skill in the art. An adhesive may also be provided between the first and second members in order to secure the first and second members in the assembled position. The card member may be any suitable size, depending upon the items to be displayed and the particular display component, and may be made from materials other than plastic, as would be known to those of skill in the art. In addition, the body portion may include indicia, such as price, manufacturer, or other information, and may have any of a number of shapes, as desired.

Referring now to FIGS. 10–13, a third embodiment of the anti-theft tag is illustrated. In this embodiment, all parts which are the same, or similar to, corresponding parts of the embodiment 10 of FIGS. 1–5 are noted with the same two last numbers, but preceded by the numeral "2". In the present embodiment, tag 210 includes a body portion 214 having a first member 216 and a second member 218. The first member 216 includes rear or inner surface 220 and front or outer surface 222 both of which are preferably substantially planar. The second member 218 also preferably includes a substantially planar rear or inner surface 224 and front or outer surface 226, along with an opening 228 disposed there through.

Figures 10, 11:
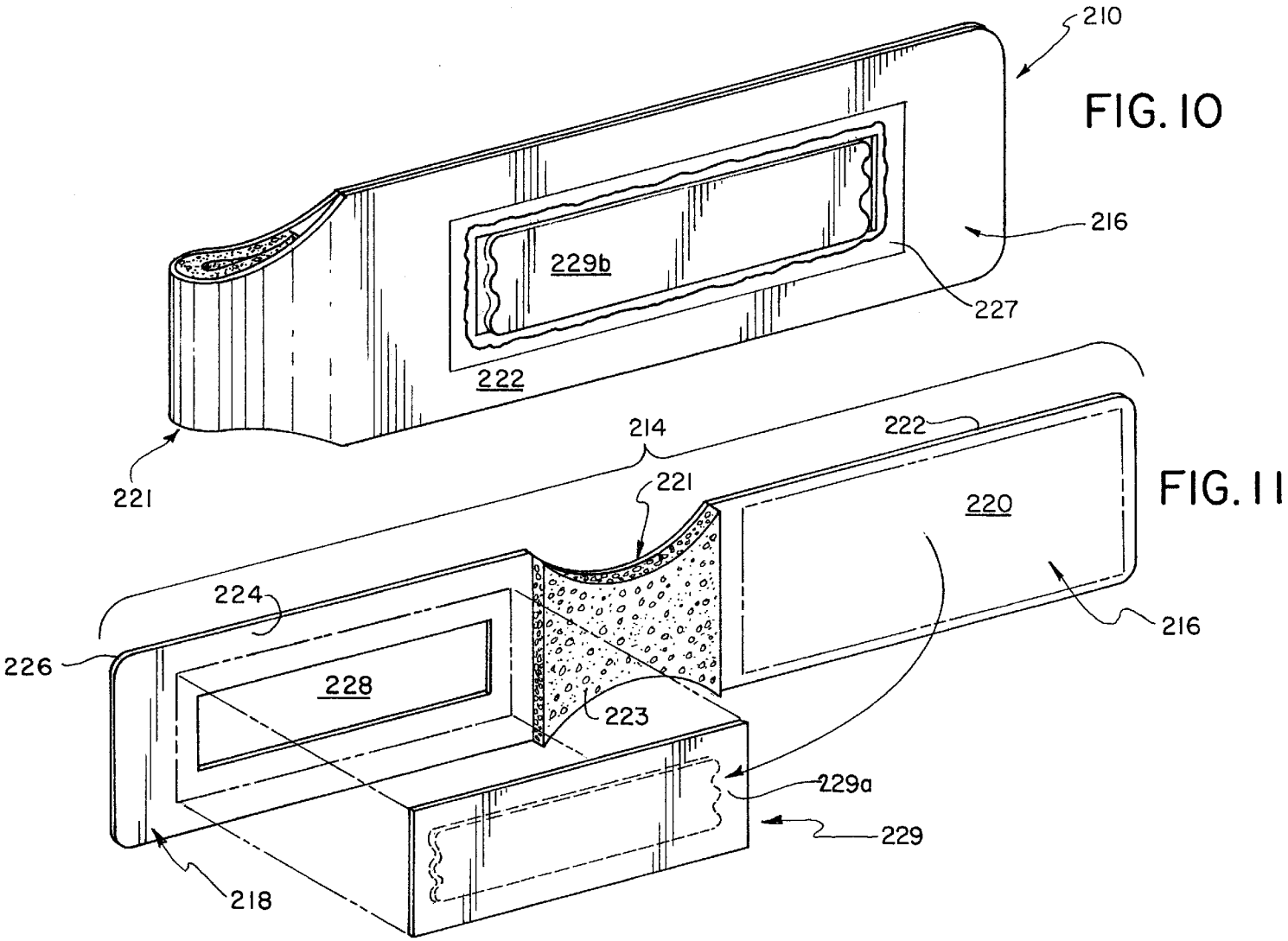
FIG. 10 is a rear, perspective view of a third embodiment of an anti-theft tag according to the present invention.
FIG. 11 is a rear, perspective view of the anti-theft tag of FIG. 10 in an open or unassembled position.
Figure 12:
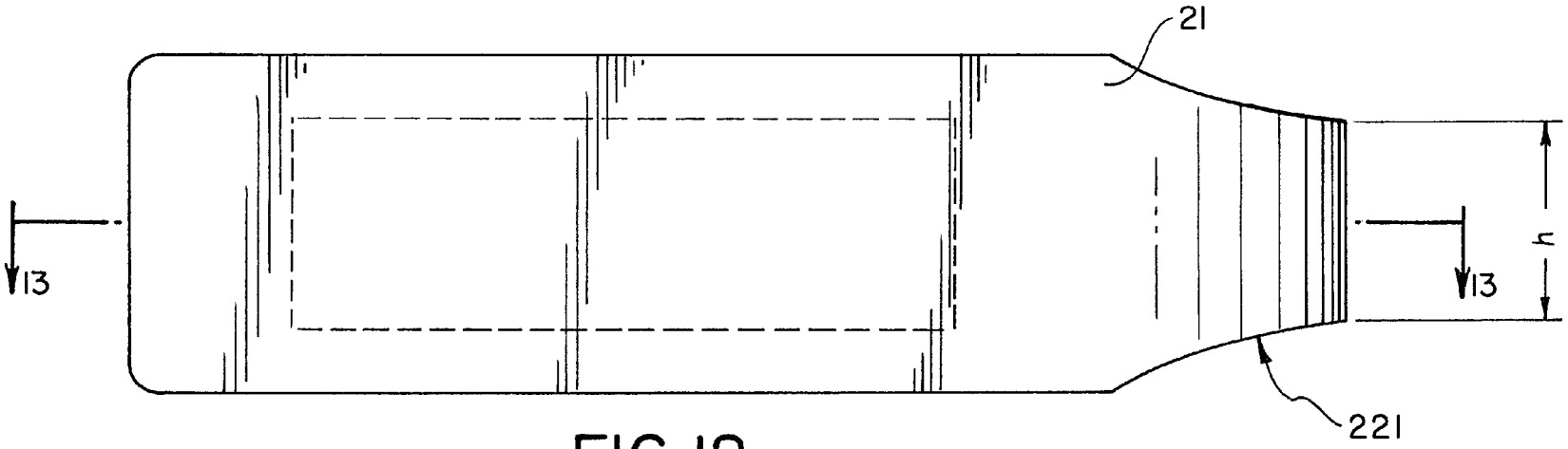
FIG. 12 is a front view of the anti-theft tag of FIG. 10.
Figure 13:
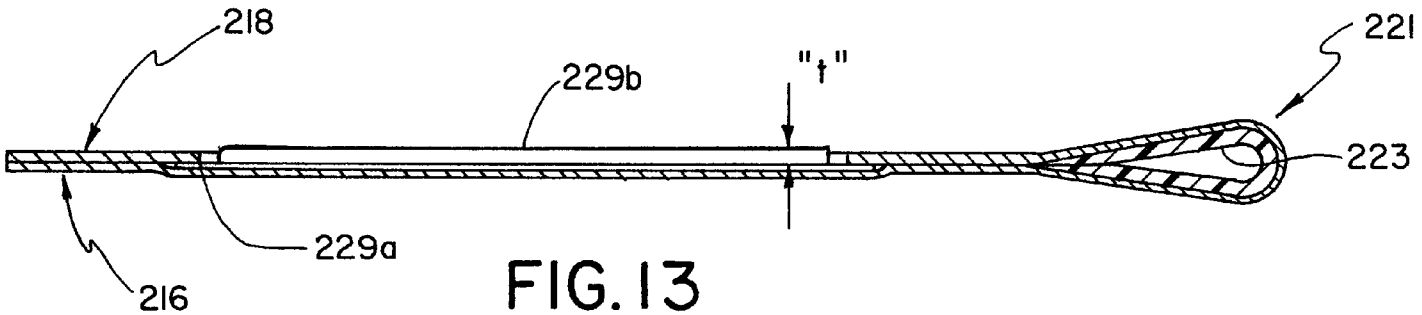
FIG. 13 is a top, cross-sectional view taken along lines 13—13 of FIG. 12.
Figure 15:
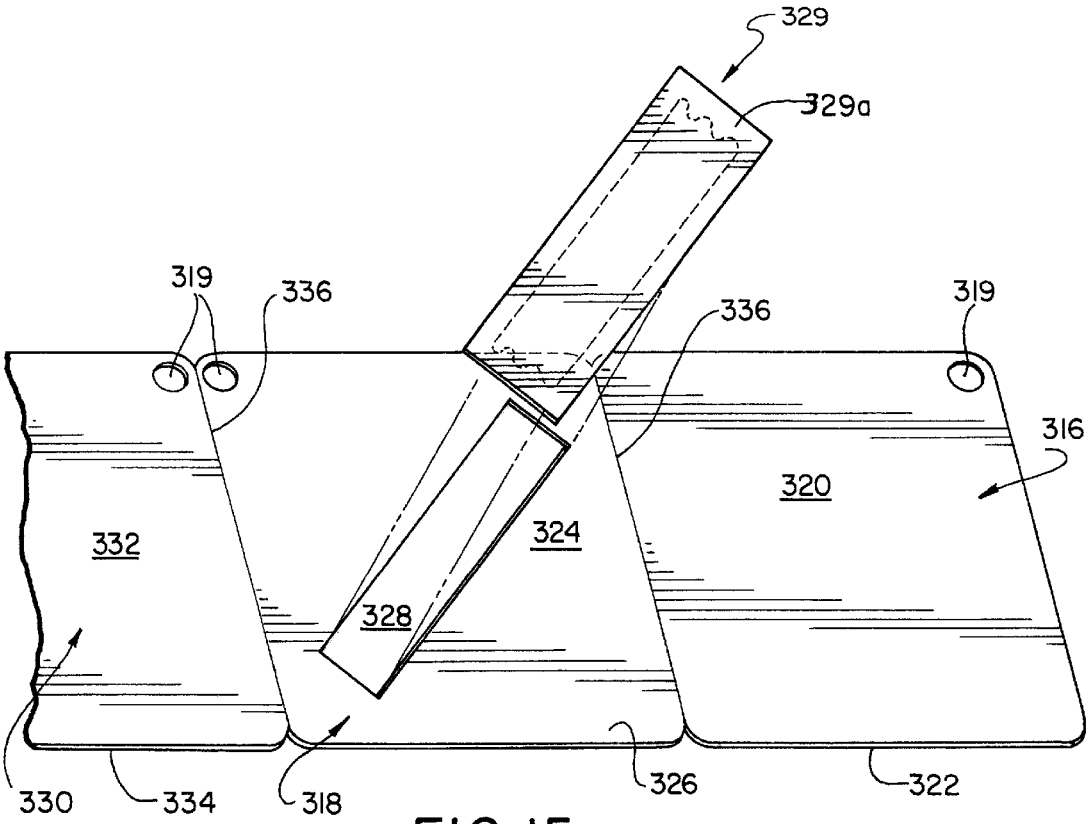
FIG. 15 is a rear, perspective view of the anti-theft tag of FIG. 14 in an open or unassembled position.

In the assembled position, the EAS marker 229, may be supported on the inner surface 220 of the first member and is preferably sized such that at least a portion of the marker fits within the opening 228 of the second member (FIG. 10). The rear base surface 229*a* of the EAS marker may be provided with a suitable adhesive in order to secure the EAS marker to the inner planar surface of the first member. Alternatively, an adhesive may be applied to a front surface 229*b* of the marker, around a perimeter thereof, and secured to the inner surface 224 of the second member. The thickness of the EAS marker and second member in the present embodiment may be such that the front surface 229*b* of the EAS marker is substantially equal in height, or level with the rear surface of the second member when received within the opening (FIG. 13). In this manner, a label 227 may be placed over the opening 228 and EAS marker, and secured to the rear surface of the second member such that the label appears substantially flat, without a noticeable bulge indicating the presence of an EAS marker. Alternatively, the EAS marker may extend through the opening and not be substantially level with the rear surface of the second member, as described in greater detail above with respect to the embodiment of FIGS. 1–5.

The first and second members 216, 218 may preferably be formed as a single, unitary member which is semi-flexible so that the tag can be folded without breaking. In the present embodiment, the first member is preferably attached to the second member by a connecting piece 221 which is also where the tag is folded in order to at least partially, and preferably substantially overlay the second member onto the first member. The connecting piece 221 may also be used in the present embodiment as an engagement member in order to attach the tag to an article. For example, when utilized with eye wear, the connecting piece may be folded about the temple bars of the eye wear. The connecting piece 221 may have a height, "h" which is less than the height of the first and second members in order to facilitate folding of the tag. The connecting piece may also include padding or cushioning 223 to prevent scratching the article to which it is attached. An adhesive may also be provided between the first and second members in order to secure the first and second members in the assembled position. The tag 210 may be any suitable size, may include indicia, such as price, manufacturer, or other information, and may have any of a variety of shapes, depending upon the particular application or upon the preference of the designer. The tag may also be made from any of a variety of materials, as would be known to those of skill in the art.

Referring now to FIGS. 14–17, a fourth embodiment of the anti-theft tag is illustrated. In this embodiment, all parts which are the same, or similar to, corresponding parts of the embodiment 10 of FIGS. 1–5 are noted with the same two last numbers, but preceded by the numeral "3". In the present embodiment, tag 310 includes an engagement member 312 for securing the anti-theft tag to an article, and body portion 314 having at least a first member 316 and a second member 318. In the present embodiment, the engagement member is an opening or aperture 319 formed in the body portion. The first member 316 includes a rear or an inner surface 320 and a front or outer surface 322, both of which are preferably substantially planar. The second member 318 also preferably includes an inner surface 324, an outer surface 326, both of which are also preferably substantially planar, and an opening 328 disposed through the second member 318 and extending between the inner and outer planar surfaces.

Figure 14:
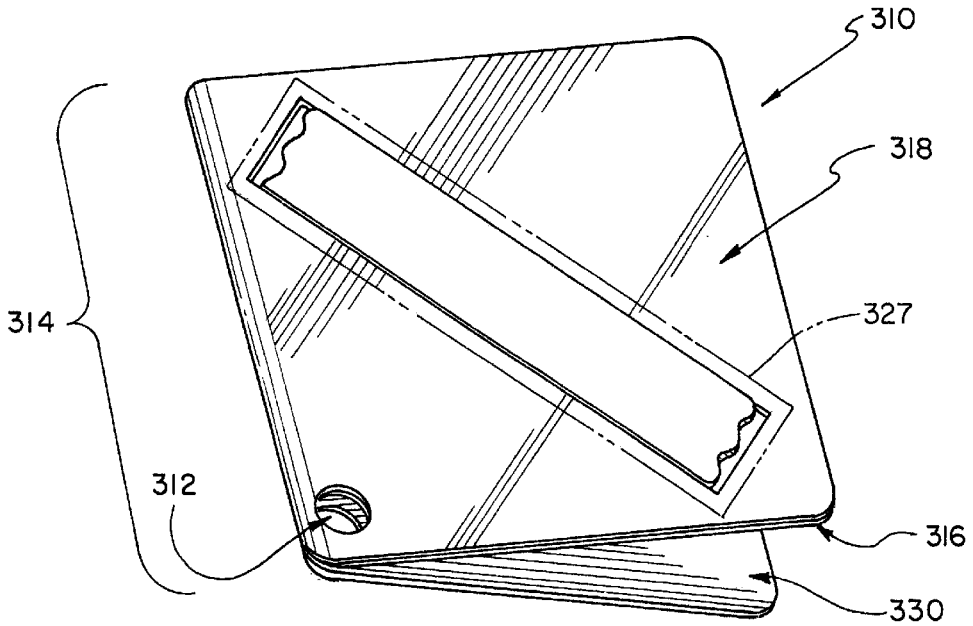
FIG. 14 is a rear, perspective view of a fourth embodiment of an anti-theft tag according to the present invention.
Figure 17:
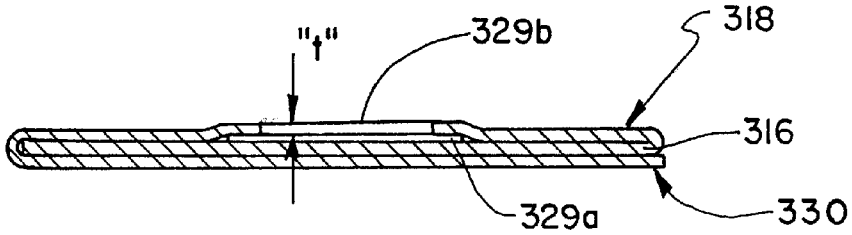
FIG. 17 is a side, cross-sectional view taken along lines 17—17 of FIG. 16.
Figure 16:
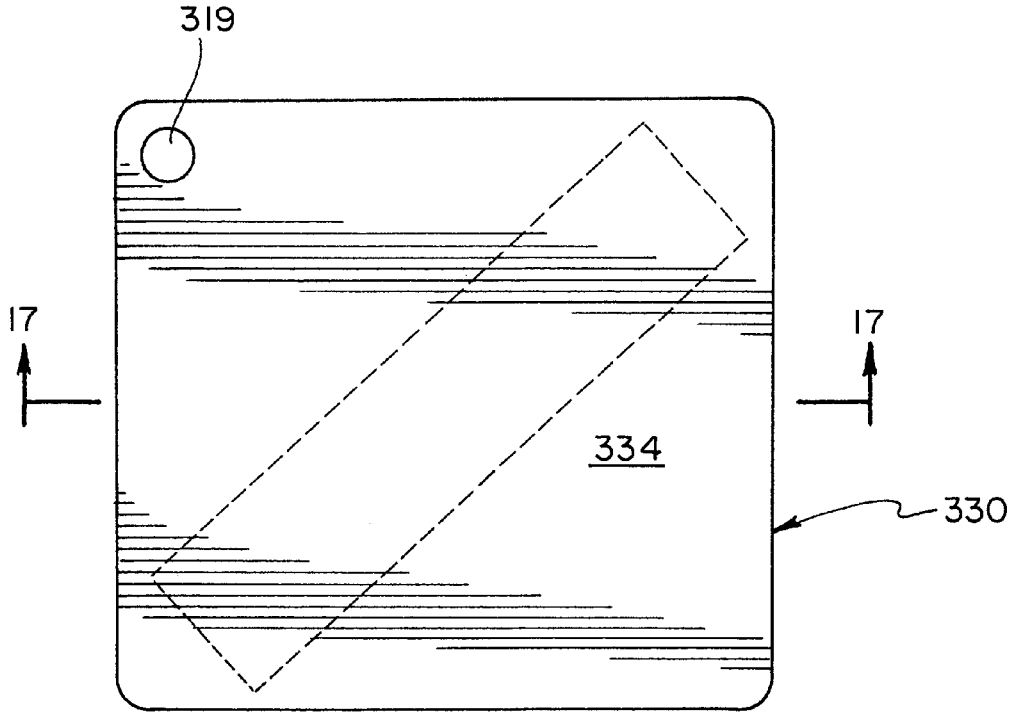
FIG. 16 is a front view of the anti-theft tag of FIG. 14.
Figure 19:
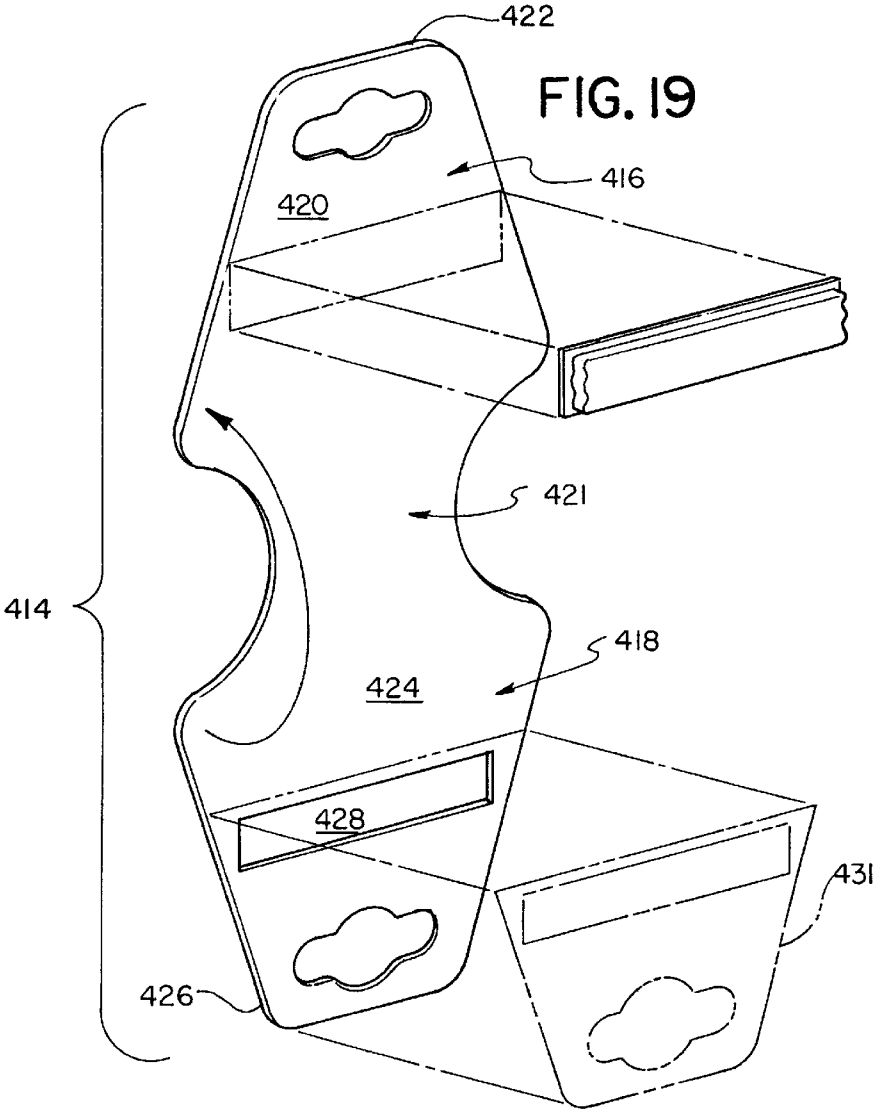
FIG. 19 is a rear, perspective view of the anti-theft tag of FIG. 18 in an open or unassembled position.

In the present embodiment, a third member 330 may also be provided which preferably includes a substantially planar inner 332 and outer 334 surface. The third member 330 is preferably supported on the second member 318 and is disposed adjacent the first member 318 in the assembled position (FIGS. 14 and 17). In this manner, the first, second and third members form a booklet-like configuration where indicia or information 346 may be printed on one or more of the first, second and third members. The first, second and third members may be formed as a single, unitary member and may include pre-formed score or fold lines 336 disposed there between in order to assist in the assembly of the tag.

In the assembled position, the EAS marker 329, may be supported on the inner surface 320 of the first member and is preferably sized such that at least a portion of the marker fits within the opening 328 of the second member (FIG. 14). The rear base surface 329*a* of the EAS marker may be provided with a suitable adhesive in order to secure the EAS marker to the inner planar surface of the first member. Alternateively, an adhesive may be applied to a front surface 329*b* of the marker, around a perimeter thereof, and secured to the inner surface 324 of the second member. In the present embodiment, the thickness of the EAS marker and second member may be such that the front surface 329*b* of the EAS marker is substantially equal in height, or level with the rear surface of the second member when received within the opening (FIG. 17). In this manner, a label 327 may be placed over the opening 328 and EAS marker and secured to the rear surface of the second member such that the label appears substantially flat, without a noticeable bulge indicating the presence of an EAS marker. Alternatively, the EAS marker may extend through the opening and not be substantially level with the rear surface of the second member, and the third member may overlay the second member 318 in the assembled position as described above with reference to FIG. 2. In this manner, the EAS marker 329 and second member 318 would both preferably be sandwiched between the first member and the third member in order to conceal the EAS marker.

The first, second and third members may be formed as a single, unitary member and may include pre-formed score or fold lines 336 disposed there between in order to assist in the By assembly of the tag such that the tag can be folded without breaking. An adhesive may also be provided between the first and second members, and/or the first and third members, in order to secure the members in the assembled position. The tag 310 may be any suitable size, may include indicia, such as price, manufacturer, or other information, and may have any of a variety of shapes, depending upon the particular application or upon the preference of the designer. The tag may also be made from any of a variety of materials, as would be known to those of skill in the art.

Referring now to FIGS. 18–21, a fifth embodiment of the anti-theft tag is illustrated. In this embodiment, all parts which are the same, or similar to, corresponding parts of the embodiment 10 of FIGS. 1–5 are noted with the same two last numbers, but preceded by the numeral "4". In the present embodiment, tag 410 includes a body portion 414 having a first member 416 and a second member 418. The first member 416 includes rear or inner surface 420 and front or outer surface 422 both of which are preferably substantially planar. The second member 418 also preferably includes a substantially planar rear or inner surface 424 and front or outer surface 426, along with an opening 428 disposed there through.

Figure 18:
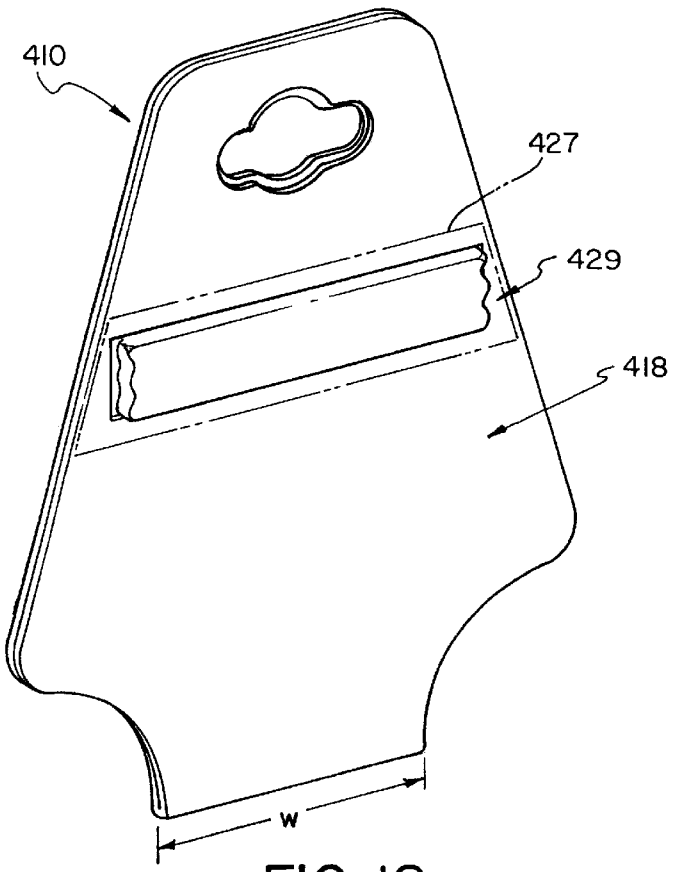
FIG. 18 is a rear, perspective view of a fifth embodiment of an anti-theft tag according to the present invention.
Figure 21:
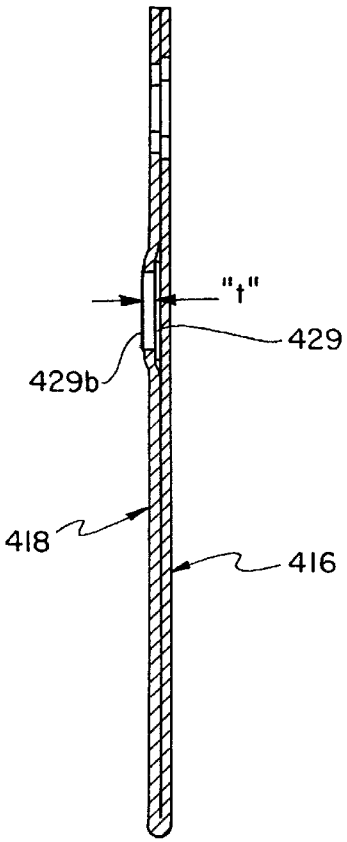
FIG. 21 is a side, cross-sectional view taken along lines 21—21 of FIG. 20.
Figure 20:
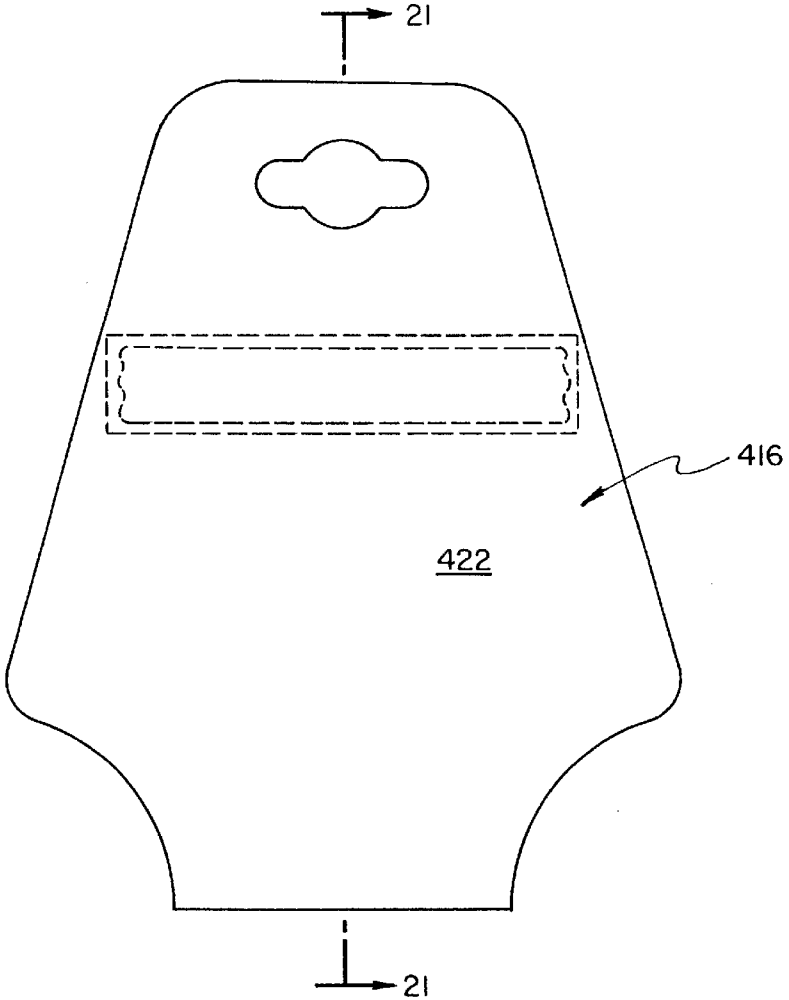
FIG. 20 is a front view of the anti-theft tag of FIG. 18.

In the assembled position, the EAS marker 429, may be supported on the inner surface 420 of the first member and is preferably sized such that at least a portion of the marker fits within the opening 428 of the second member (FIG. 18). The rear base surface 429*a* of the EAS marker may be provided with a suitable adhesive in order to secure the EAS marker to the inner planar surface of the first member. Altemateively, an adhesive may be applied to a front surface 429*b* of the marker, around a perimeter thereof, and secured to the inner surface 424 of the second member. The thickness of the EAS marker and second member in the present embodiment may be such that the front surface 429*b* of the EAS marker is substantially equal in height, or level with the rear surface of the second member when received within the opening (FIG. 21). In this manner, a label 427 may be placed over the opening 428 and EAS marker and secured to the rear surface of the second member such that the label appears substantially flat, without a noticeable bulge indicating the presence of an EAS marker. Alternatively, the EAS marker may extend through the opening and not be substantially level with the rear surface of the second member, as described in greater detail above with respect to the embodiment of FIGS. 1–5.

The first and second members 416, 418 may preferably be formed as a single, unitary member which is semi-flexible so that the tag can be folded without breaking. In the present embodiment, the first member is preferably attached to the second member by a connecting piece 421 which is also where the tag is folded in order to at least partially overlay the first member with the second member. The connecting piece 421 may also be used in the present embodiment as an engagement member in order to attach the tag to an article as described above for the embodiment of FIGS. 10–13. The connecting piece 421 may have a width, "w" which is less than the width of the first and second members in order to facilitate folding of the tag. An adhesive may also be provided between the first and second members in order to secure the first and second members in the assembled position. If desired, the adhesive may be pre-applied and covered with a protective sheet 431 to protect the adhesive during storage and prior to assembly. The tag 410 may be any suitable size, may include indicia, such as price, manufacturer, or other information, and may have any of a variety of shapes, depending upon the particular application or upon the preference of the designer. The tag may also be made from any of a variety of materials, as would be known to those of skill in the art.

Use of the anti-theft tag will now be described with reference to the drawings.

In use, regardless of the particular style tag, the body is initially in a non-engaged or open position where the body member is fully extended ( FIGS. 3, 7, 11, 15, and 19), prior to attaching the EAS marker. The EAS marker is then secured between the first and the second member. For example, the rear surface of the marker may be attached to an inner surface of the first member by a suitable adhesive, or, alternatively the perimeter of the front surface of the marker may be attached to the inner surface of the second member by adhesive. The opening in the second member, which may either be formed during manufacturing or which may be scored during manufacturing and punched out during assembly, is aligned with the EAS marker. The tag may then be folded at a fold line disposed between the first and second member, such that the second member at least partially overlays the first member and the EAS marker is at least partially received within the opening. A third member may also be provided, and may be positioned at least partially over either the first or second member. If positioned over the second member, the EAS marker is sandwiched between the first member and the third member. If the EAS marker is visible, a label may thereafter be affixed onto the rear surface of the second member such that it covers the EAS marker. The height or thickness of the EAS marker may be substantially equal or level with the rear surface of the second member when assembled. In this manner, when the label is placed over the opening and EAS marker the label appears substantially flat, without a noticeable bulge indicating the presence of an EAS marker. Alternatively, the EAS marker may extend from the opening of the second member, as described in greater detail above. The first, second, and/or third members may be secured together with a suitable adhesive, if desired. The body portion may include indicia, such as price, manufacturer, or other information, may be any suitable size, and may have any of a variety of shapes, depending upon the particular application or upon the preference of the designer. The tag may also be made from any of a variety of materials, as would be known to those of skill in the art. Once assembled, the tag may be engaged with the article to be displayed, by an engagement member such as an opening which may receive a string or other member therethrough.

It will be understood that various modifications may be made to the embodiments disclosed herein. For example, it should be understood that the first, second and/or third members need not be unitary in construction, that the shape and size of the anti-theft tag may vary, that adhesive to secure the members together may not be required, and that any suitable material may be utilized for the tag. In addition, the score or fold lines and the label need not be provided, and the opening may be formed during assembly. Therefore, the above description should not be construed as limiting, but merely as exemplifications of preferred embodiments. Those skilled in the art will envision other modifications within the scope, spirit and intent of the invention.

What is claimed is:

1. An anti-theft tag for supporting an electronic article surveillance marker comprising:

a body portion including:

a) a first member having a substantially continuous inner planar surface and outer planar surface;

b) a second member having an inner planar surface, an outer planar surface, and an opening disposed therethrough; and wherein in an assembled position at least a portion of the electronic surveillance marker is supported on the inner planar surface of the first member, and wherein the second member at least partially overlays the first member such that at least a portion of the electronic article surveillance marker is received within the opening.

2. The anti-theft tag of claim 1, further comprising a third member having a substantially continuous inner planar surface and outer planar surface.

3. The anti-theft tag of claim 2, wherein in the assembled position the third member at least partially overlays the second member and the electronic article surveillance marker such that the electronic article surveillance marker is sandwiched between the first member and the third member.

4. The anti-theft tag of claim 2, wherein the first, second and third members are formed as a single, unitary piece.

5. The anti-theft tag of claim 4, wherein the first member is disposed between the second and third members.

6. The anti-theft tag of claim 1, wherein the first and second members are formed as a single, unitary piece.

7. The anti-theft tag of claim 6, further comprising a pre-formed fold line disposed between the first member and the second member, the fold line being constructed and arranged to facilitate folding of the tag member in order to at least partially overlay the first member with the second member.

8. The anti-theft tag of claim 1, further comprising a label constructed and arranged to overlay the electronic article surveillance marker and the opening in the assembled position.

9. The anti-theft tag of claim 1, further comprising an engagement member constructed and arranged to engage an article.

10. The anti-theft tag of claim 1, wherein the electronic article surveillance marker is secured to the inner planar surface of the first member by an adhesive.

11. The anti-theft tag of claim 1, wherein the electronic article surveillance marker is secured to the inner planar surface of the second member by an adhesive.

12. The anti-theft tag of claim 1, in combination with the electronic article surveillance marker sized to at least partially fit within the opening.

13. The anti-theft tag of claim 12, wherein the EAS marker includes a rear surface adjacent the inner surface of the first member, and a front surface substantially level with the rear surface of the second member when received within the opening in the assembled position.

14. The anti-theft tag of claim 1, wherein the body portion is constructed and arranged to be attached to eye wear and includes a generally rectangular portion and an arcuate portion which extends from an upper edge of the rectangle portion such that when the tag is attached to the eye wear the anti-theft tag does not overly obscure the consumer's vision.

15. An anti-theft tag comprising:

a first member having a substantially continuous inner planar surface and outer planar surface;

a second member having an inner planar surface, an outer planar surface, and an opening disposed therethrough;

a third member having a substantially continuous inner planar surface and outer planar surface;

an electronic article surveillance marker supported on the front planar surface of the first member and sized to fit within the opening; and wherein in an assembled position the inner planar surface of the second member at least partially overlays the inner planar surface of the first member such that the electronic article surveillance marker is received within the opening, and the third member at least partially overlays the outer planar surface of the second member such that the electronic article surveillance marker is sandwiched between the inner planar surface of the first member and the inner planar surface of the third member.

16. The anti-theft tag of claim 15, wherein the first, second and third members are formed as a single, unitary piece.

17. The anti-theft tag of claim 16, wherein the first member is disposed between the second and third members.

18. The anti-theft tag of claim 15, further comprising a label constructed and arranged to overlay the electronic article surveillance marker and the opening in the assembled position.

19. The anti-theft tag of claim 15, further comprising an engagement member constructed and arranged to engage an article.

20. The anti-theft tag of claim 15, wherein the electronic article surveillance marker is secured to the inner planar surface of the first member by an adhesive.

21. The anti-theft tag of claim 15, wherein the electronic article surveillance marker is secured to the inner planar surface of the second member by an adhesive.

22. The anti-theft tag of claim 15, wherein the EAS marker includes a rear surface adjacent the inner surface of the first member, and a front surface of the EAS marker is substantially level with the rear surface of the second member when received within the opening.

23. A method of forming an anti-theft tag comprising the steps of:

providing a body portion including a first member having a substantially continuous inner planer surface, and a second member having an inner planar surface, an outer planar surface and an opening disposed therethrough;

supporting an electronic article surveillance marker on the inner planar surface of the first member;

aligning the electronic article surveillance marker with the opening disposed through the second member;

folding the body portion such that at least a portion of the inner surface of the second member overlays the first member and the electronic article surveillance marker is at least partially received within the opening; and securing the electronic article surveillance marker between the first member and the second member.

24. The method of claim 23, further comprising the step of overlaying the electronic article surveillance marker and at least a portion of the second member with a third member having an inner surface and an outer surface such that the electronic article surveillance marker is sandwiched between the inner surface of the first member and the inner surface of the third member.

* * * * *